United States Patent [19]

Scherübl

[11] Patent Number: 4,848,784

[45] Date of Patent: Jul. 18, 1989

[54] SKI WITH DAMPER PROCESSED IN ITS CORE

[75] Inventor: Franz Scherübl, Schwemmberg, Austria

[73] Assignee: Atomic Skifabrik Alois Rohrmoser, Austria

[21] Appl. No.: 53,967

[22] Filed: May 26, 1987

[30] Foreign Application Priority Data

May 27, 1986 [AT] Austria ..... 1409/86

[51] Int. Cl.[4] ..... A63C 5/07

[52] U.S. Cl. ..... 280/602; 280/608

[58] Field of Search ..... 280/602, 608, 609, 610

[56] References Cited

U.S. PATENT DOCUMENTS 3,580,596 5/1971 Volkl ..... 280/608
3,582,098 6/1971 Michal ..... 280/608
4,068,861 1/1978 Zemke, Jr. ..... 280/608
4,697,820 10/1987 Hagashi et al. ..... 280/602

FOREIGN PATENT DOCUMENTS 150446 6/1955 Switzerland ..... 280/602

*Primary Examiner*—Charles A. Marmor
*Assistant Examiner*—Richard Camby
*Attorney, Agent, or Firm*—Andrus, Sceales, Starke & Sawall

[57] ABSTRACT

Ski with an upper layer, a lower layer, and optionally an intermediate layer. The ski has a central core made of a hard material, especially a hard wood, and has a running surface and laterally extending edge protectors. At least one of the two outer surfaces of the core has one or more recesses for matching damper elements made of an elastic material.

13 Claims, 3 Drawing Sheets

Fig. 1
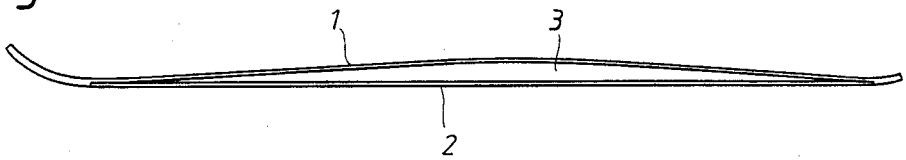
Fig. 2
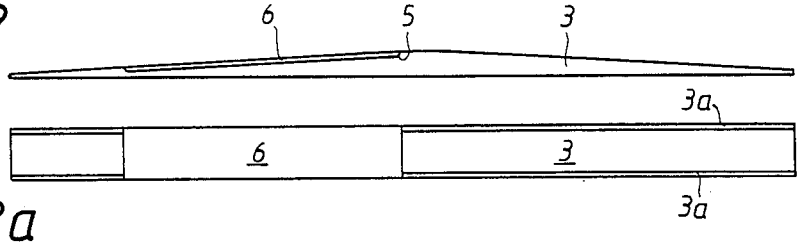
Fig. 2a
Fig. 3
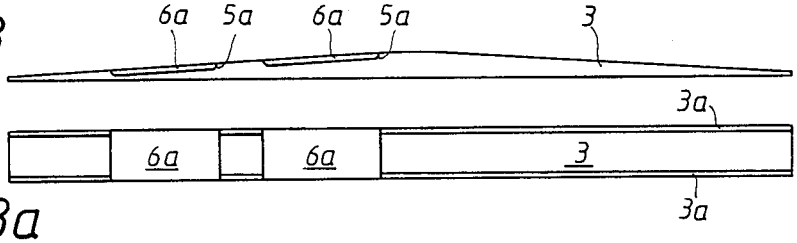
Fig. 3a
Fig. 4
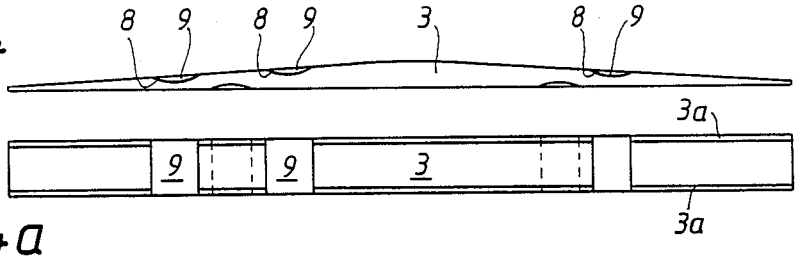
Fig. 4a Fig.5
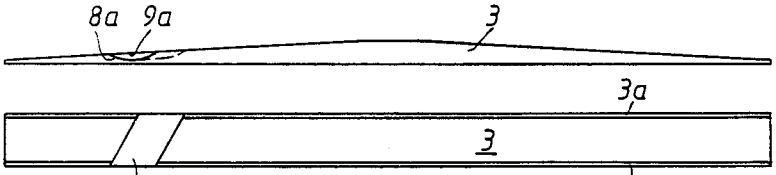
Fig.5a
Fig.6
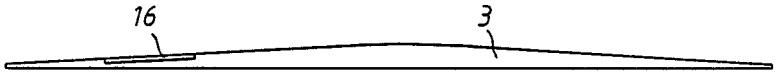
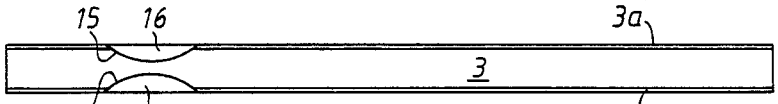
Fig.6a
Fig.7
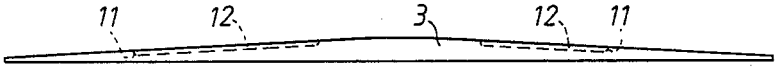
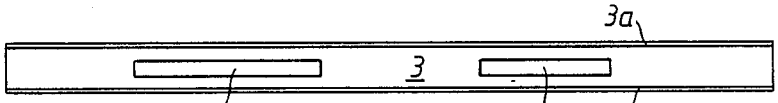
Fig.7a
Fig.8
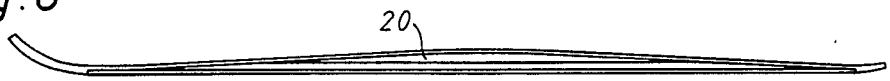
Fig.9
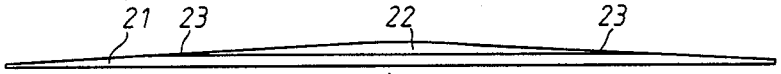
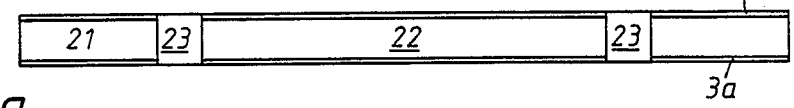
Fig.9a

SKI WITH DAMPER PROCESSED IN ITS CORE

FIELD OF THE INVENTION

My present invention relates to a ski of sandwich construction, i.e. having upper and lower skins or plies and a core of hard material bonded between the plies.

BACKGROUND OF THE INVENTION

A ski which is of a sandwich or laminate construction, can include a top layer or ply (upper skin), a bottom layer or ply (lower skin and running surface), one or more intermediate layers when desired, and a core disposed between the two exterior layers. The core element is preferably made of a hard wood.

The ski may also include a skiing or running surface and protective edge members, or side walls or bottom edges, which are arranged laterally with respect to the running surface or sole of the ski.

It is known that kicks, shocks and like impacts on skis give rise to tensile and compressive stresses in the longitudinal layers, and such stresses generally propagate in wave-like manner with a given vibrational frequency at the interfaces of the core with the upper and lower layers.

This variation detrimentally affects the skiing behavior and responsiveness of the ski.

OBJECTS OF THE INVENTION

It is therefore the principal object of the present invention to provide a ski in which transfer of the vibrations along the outer regions of the core is substantially reduced.

It is also an object of the invention to provide a ski with enhanced stability.

SUMMARY OF THE INVENTION

These and other objects of the invention are obtained by forming at least one of the two outer walls of the core is formed with at least one damper element of an elastic material.

In accordance with one embodiment it is preferred that in the upper side and/or the bottom side of at least one core there is worked-in a damper element, or several damper elements which are positioned at spaced intervals with respect to one another. The or each damping element can be recessed in the hard core at the aforementioned interface or at both interfaces.

For a very effective damping of the vibrations which are propagated across the ski, as caused by shocks or other detrimental impacts on the forward portion of the ski, in the forward portion of the core for a ski at least one damper element can be worked-in, or in other words, the surface of the core is finished with the inclusion of at least one damper element.

When the core is comprised of several parts, the desired damping is attained by replacing an end portion of at least one of the core parts by a correspondingly shaped damper element.

The damper element can have a width which corresponds to one third of the width of the respective core.

The length of the damper element is such that it extends over the full width of the respective core and preferably over the full width of the skins.

The damper element can have a rectangular cross section, i.e., a plate-like configuration, or it can have an approximately circular sectoral or segmental cross section.

The damper can have a sectoral shape when considered in plan view with the chord coinciding with the lateral longitudinal edge of the core.

The damper element has preferably width such that it extends fully through the lateral walls or edge protectors which are positively secured to the core.

The provision of the damper in at least one outer surface or skin of the core ensures that any vibrations effect a deformation of the damper element is achieved for reduction or elimination the vibrational energy. Thus, in comparison with a conventional ski, the improved ski effects a reduction of vibrations and are of increased stability.

DESCRIPTION OF THE DRAWING

The above and other objects, features and advantages will become apparent from the following description, reference being made to the accompanying drawing in which:

FIG. 1 is a side elevation of a ski with a single core;

FIGS. 2 to 7 are core side elevations of a number of embodiments of the invention; and FIGS. 2*a* to 7*a* are corresponding top plan views;

FIG. 8 is a side elevation of a ski with two core elements;

FIG. 9 is a side elevation of the core for a ski according to FIG. 8;

FIG. 9*a* is a top plan view of the core for a ski according to FIG. 8.

SPECIFIC DESCRIPTION

Figure 10:
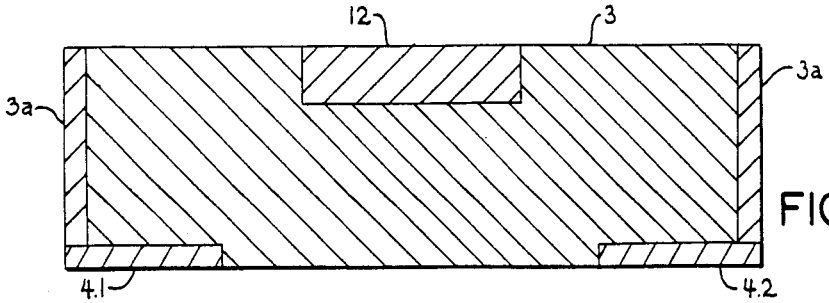
FIG. 10 is a transverse cross section through the core of FIGS. 7 and 7*a* showing more one type of edge protectors.

The ski shown in FIG. 1 is comprised of the known components, namely an upper ply or top layer (upper skin) 1, a bottom layer or ply (bottom skin) 2, and a core 3 which is arranged between the top layer 1 and the bottom layer 2. The core 3 is made of a hard material, preferably a hard wood.

The ski has a skiing or running surface or sole 4 and edge protectors 4.1 and 4.2, respectively. These elements of the ski are standard in the art and need not be described herein in detail because further description is not required for an understanding of this invention.

As is indicated in FIGS. 2 and 2*a*, which generally show only the body of the core 3, the forward half of the core 3 is formed with a shallow recess 5 in which can be fixed a plate 6 with damping properties. The plate 6 is hereinafter also referred to as the damper plate 6 and can be composed of rubber or some other vibration-damping material.

The damper plate 6 extends substantially over the full length of the forward half of the ski and, accordingly, the core and the full width of the ski. Thus, the damper plate 6 extends, by way of respective slots in the lateral side walls 3*a* on either side of the core 3 so as to extend the full width thereof and of the ski. The side walls 3*a* are positively secured to the core 3 and serve, in turn, also as respective edge protectors for the core 3 and the respective ski.

The embodiment shown in FIGS. 3 and 3*a* has a spaced pair of damper plates 6*a* which are respectively secured in recesses 5*a*. The damper plates 6*a* also extend over the full width of the ski and the core 3, and the respective lateral walls 3*a* are discontinuous, i.e. ar provided with corresponding apertures, in conformity with the length of the plates 6*a*.

The embodiment of FIGS. 4 and 4*a* has a core 3 with recesses 8 formed in the upper wall of the core 3, i.e., in the forward half and the rearward half of the core 3, as well as in the lower wall, but here only in the other, rearward half thereof. These recesses 8 are circular sectoral when viewed inside elevation (FIG. 4) and they extend in an arcuate pattern to the outer edge of the core 3 which is facilitated by respective rounded apertures or grooves in the lateral walls 3*a*.

These recesses 8 serve to receive damper plates or elements 9 in the core 3, i.e. in the respective surface or skin thereof at the interface with an upper or lower ply. The damper plates 9 are provided at the top side and the bottom side of the core 3 in this embodiment.

In the embodiment shown in FIGS. 5 and 5*a*, the top side of the forward portion of the ski has a sectorial or rounded recess 8*a* which extends with its central axis at an angle of approximately 70° with respect to the central longitudinal axis of the ski. The recess 8*a* extends to the outer edges of the core 3 which is facilitated by respective rounded apertures or grooves in the lateral walls 3*a*. This upper recess 8*a* is for the damper element 9*a* which has a corresponding curvature at its bottom, but it is flush with the top surface of the core 3.

The embodiment in FIGS. 6 and 6*a* has arcuate recesses 15 when viewed in plan, and the respective chords coincide with the other edge of the lateral walls 3*a*. Damper plates 16 with matching shape are fixed in the recesses 15.

In the embodiment of FIGS. 7 and 7*a*, the core 3 is formed with recesses 11 in the upper surface in the forward half and the rearward half of the ski. The recesses 11 are centrally arranged in the core 3 and the width of each recess 11 is approximately one-third of the width of the core 3. The recesses 11 are shaped to fix the matching damper plates 12 (See also FIG. 10). These recesses 11 are rectangular when viewed in plan view (FIG. 7*a*) and the central longitudinal axes thereof extend coincidentally with the central longitudinal axis of the core 3.

A ski with a dual core is shown in FIG. 8, i.e. a core 20 which is made up of two layers.

With reference to FIGS. 9 and 9*a*, the core 20 is comprised of a bottom part 21 and an upper part 22, whereby the feathering ends of the upper part 22 are replaced by damper plates 23 which extend over the full width of the core 20. Again, the damper plates 23 extend flush with the outer edges of the core 20 by means of the slots or apertures which are formed in the associated lateral walls 3*a* which are positively secured to the core 20.

The core embodiments described serve to appreciably dampen or alleviate the vibrations which are propagated along the lateral peripheral edge regions of the core. Thus, the improved ski, when compared with a ski with a conventional core, has enhanced dampening properties to preclude or reduce vibrations.

It is to be stressed that an important feature of the invention resides therein that the core has a discontinuous surface or skin, i.e. a surface or skin which is not closed, but has surface regions which are distinct due to the respective damper elements and which disrupt the continuous outer surface.

The resulting effects can not be achieved by merely arranging damper elements at the skin or outer surfaces of the core, because the vibrations are not effectively precluded by the damper elements from propagating along the outer surface of the core.

In contrast, with the present invention, the effective damping is achieved when the damper elements are mounted in recesses or apertures formed in the core.

It is also of note that the dimensioning and arrangement of the damper elements is to be done in accordance with the structure and design of the ski. Thus, a ski made of aluminum layers, i.e., an upper layer and a lower layer, requires more damper elements than a ski which s made of several layers of a material which with reference to an aluminum ski has a greater propensity to resist vibrations.

Figure 11:
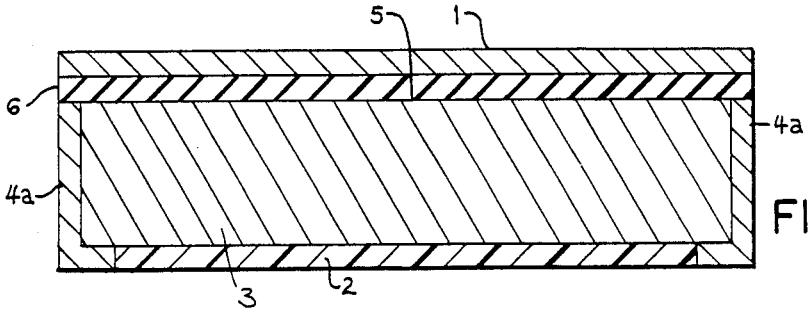
FIGS. 11–13 are transverse ski sections showing other damper arrangements.
Figure 11A:
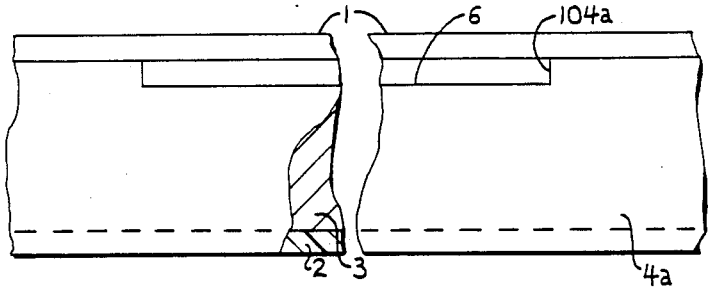
FIG. 11*a* is a fragmentary side view of the ski of FIG. 11.

In FIGS. 11 and 11*a*, I have shown a ski provided with the core of FIGS. 2 and 2*a*and edge protectors 4*a*which have slots 104*a* through which the elastomeric damper plate 6 extends. The lower ply 2 can have a further layer forming the running surface.

Figure 12:
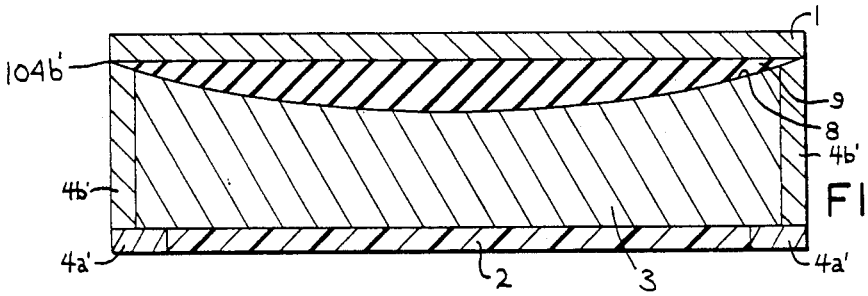

FIG. 12 shows a ski using the damper plates 9 of FIGS. 4 and 4*a*. Here the damper projects through slots 104*b*′ in the edge protectors. The latter are formed with flank strips 4*b*′ meeting the edge strips 4*a*′ flanking the lower ply 2.

Figure 13:
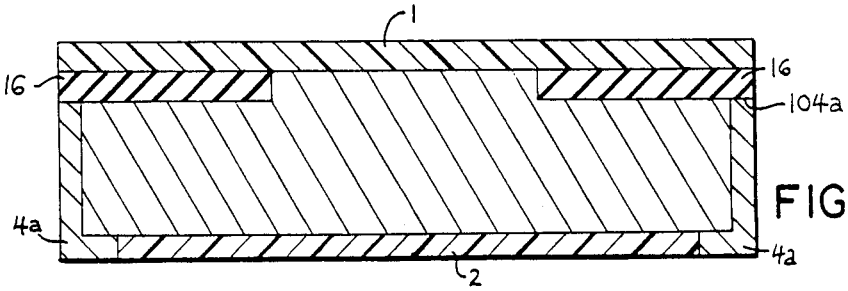

FIG. 13 shows a ski using the dampers 16 of FIGS. 6 and 6*a* in which these dampers also extend through slots 104*a* in the edge protectors 4*a*.

I claim:

1. A ski comprising:

a composite multilayer structure with an upper layer, a lower layer, and at least one core of a hard material arranged between respective layers, and edge protection means along the lateral sides of said structure, said lower layer being formed with a running surface, and at least one damper element of an elastic material recessed in at least one outer surface of said core adjacent a corresponding one of said layers, said edge protection means including lateral walls which are discontinuous to allow mounting of the respective damper element thereat.

2. The ski according to claim 1 wherein at least two damper elements are positively secured flush with the respective outer surfaces, and are spaced from one another.

3. The ski according to claim 1 wherein said core is comprised of several parts, and wherein at least one core part has a portion made of the same material as said damper element.

4. The ski according to claim 3 wherein at least one tip of a core part is a damper element.

5. The ski according to claim 1 wherein said damper element has an approximately rectangular cross section.

6. The ski according to claim 1 wherein said damper element has an approximately sectoral cross section.

7. The ski according to claim 1 wherein said damper element extends at an angle of approximately 70° with respect to the longitudinal central axis of the ski.

8. The ski according to claim 1 wherein in at least one outer wall of said core at least one aperture is formed which is sectoral when viewed in plan view and a chord thereof is coincidental with the lateral longitudinal edge of said core, said damper element having matching sectoral shape in conformity with said sectoral aperture.

9. The ski according to claim 8 wherein said damper element is a plate.

10. The ski according to claim 1 wherein at least one portion of said damper element (9,16) has an arcuate profile.

11. The ski according to claim 10 wherein said arcuate profile of said damper element (9) extends vertically relative to said layers.

12. The ski according to claim 10 wherein said arcuate profile of said damper element (16) extends parallel relative to said layers.

13. The ski according to claim 10 wherein a pair of damper elements (16) are provided and with said last-named elements having opposed arcuate profiles extending parallel relative to said layers.

* * * * *